US006264131B1

(12) United States Patent
Tsai

(10) Patent No.: US 6,264,131 B1
(45) Date of Patent: Jul. 24, 2001

(54) ROLLING UP DEVICE FOR WET PAPER TOWELS

(75) Inventor: Chin-Chin Tsai, Pingtung Hsien (TW)

(73) Assignee: Yen Sun Technology Corp., Kaohsiung Hsien (TW)

( * ) Notice: Subject to any disclaimer, the term of this patent is extended or adjusted under 35 U.S.C. 154(b) by 0 days.

(21) Appl. No.: 09/558,845

(22) Filed: Apr. 27, 2000

(51) Int. Cl.[7] ..... B65H 18/14
(52) U.S. Cl. ..... 242/541.3; 242/566
(58) Field of Search ..... 242/541.2, 541, 242/540, 541.3, 564.3, 564.4, 566

(56) References Cited

U.S. PATENT DOCUMENTS 1,658,095 * 2/1928 Paschen ..... 242/564.3
4,078,738 * 3/1978 Nakamura ..... 242/541
5,803,397 * 9/1998 Chang ..... 242/541.2
6,050,519 * 4/2000 Biagiotti ..... 242/541.2

FOREIGN PATENT DOCUMENTS 343526 10/1998 (TW) .

* cited by examiner

*Primary Examiner*—Emmanuel M. Marcelo
(74) *Attorney, Agent, or Firm*—Bacon & Thomas, PLLC

(57) ABSTRACT

A rolling up device for rolling up wet paper towels includes a main body with two side plates. Two spaced rollers are rotatably mounted between the side plates of the main body. A rolling up belt is mounted around the rollers to rotate therewith. Individual wet paper towel is passed through a space between a rolling up plate and the rolling up belt and is thus rolled. Redundant water in individual wet paper is removed when it is passed through the rolling up plate.

5 Claims, 5 Drawing Sheets

ROLLING UP DEVICE FOR WET PAPER TOWELS

BACKGROUND OF THE INVENTION

1. Field of the Invention

The present invention relates to a rolling up device for wet paper towels that may roll up individual wet paper towel and remove redundant water content in the individual wet paper towel.

2. Description of the Related Art

Taiwan Utility Model Publication No. 343526 issued on Oct. 21, 1998 and entitled "IMPROVED STRUCTURE FOR AN AUTOMATIC WET PAPER TOWEL SUPPLIER" discloses an automatic wet paper towel supplying device comprising a supply frame with a U-shape shelf for placing a web of paper towel thereon. The web of paper towel is conveyed to a guide plate by a driving wheel and then wetted by a sprayer tube. The web of paper towel is cut to form separate paper towels each of which is conveyed through a set of wheels and then rolled up to form a rolled wet paper towel. The automatic wet paper towel supplying device is characterized by that the conveyor belt for the set of wheels includes an input section on an inverted L-shape upper end thereof and an output section on a lower end thereof. The conveyor belt is driven by a gear of a reduction motor. The reduction motor further includes a small belt wheel that is connected to a main driving wheel for an auxiliary set of wheels, thereby causing simultaneous motions of the set of wheels and the auxiliary set of wheels to make the wet paper towel move to a place below a front guide plate of a pressing plate assembly. A bending section of a front guide plate starts to roll up the wet paper towel which is then moved into a small arcuate portion for proceeding with second rolling up by an auxiliary stop plate. Next, a rear guide plate moves the wet paper towel to a conveyor belt between the auxiliary set of wheels and the output section for continuously rolling up of the wet paper towel, thereby rolling up the wet paper towel into a substantially cylindrical rolled wet paper towel by multiple rolling up procedures along with longer travel. The wet paper towel is thus rolled up reliably.

SUMMARY OF THE INVENTION

It is the primary object of the present invention to provide a rolling up device for wet paper towels that may automatically roll up individual wet paper towel and remove water in individual wet paper towel, thereby forming a rolled wet paper towel.

A rolling up device for rolling up wet paper towels includes a main body with two side plates. Two spaced rollers are rotatably mounted between the side plates of the main body. A rolling up belt is mounted around the rollers to rotate therewith. Individual wet paper towel is passed through a space between a rolling up plate and the rolling up belt and is thus rolled. Redundant water in individual wet paper is removed when it is passed through the rolling up plate.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 1:
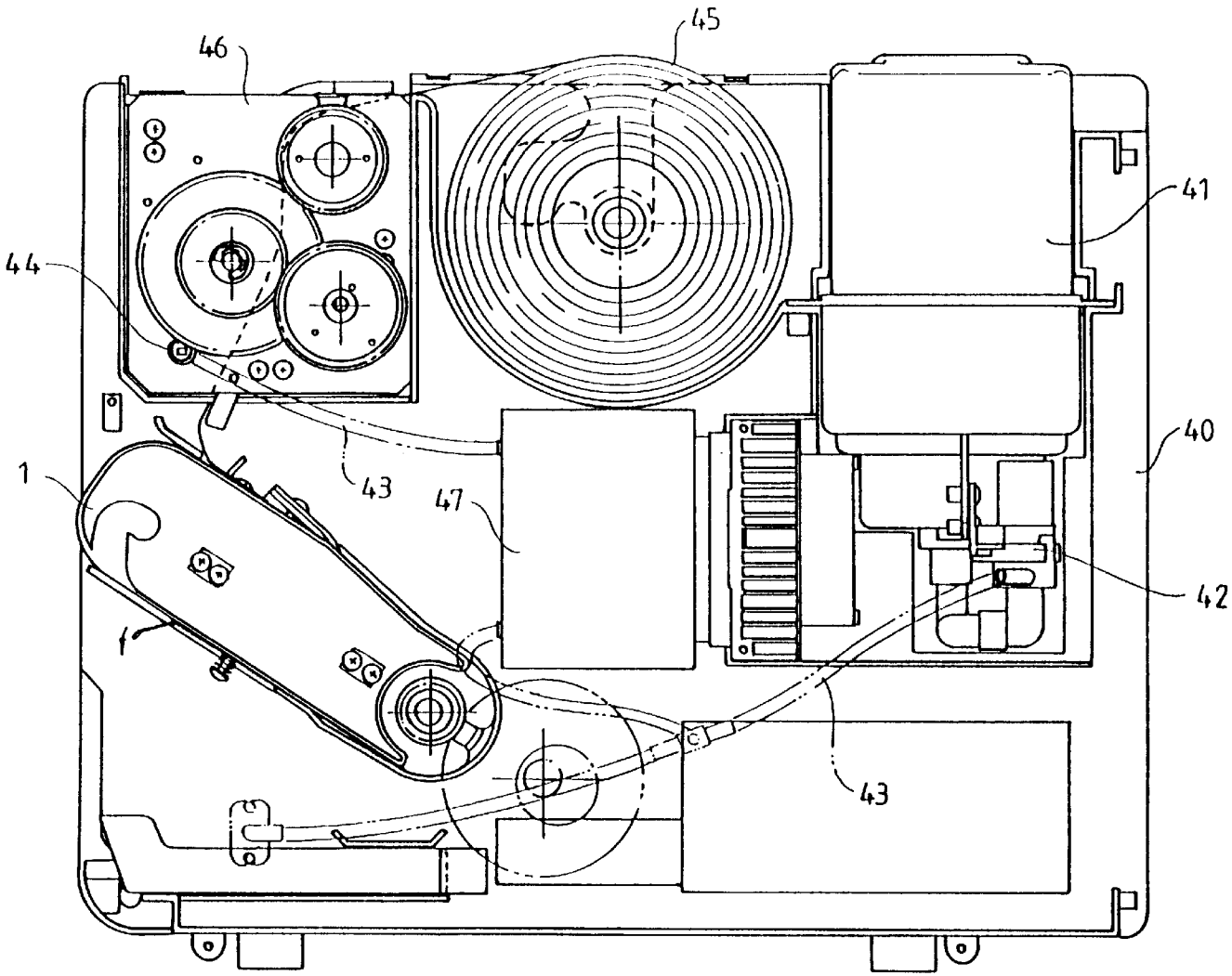
FIG. 1 is a top view of a wet paper towel producing apparatus with a rolling up device in accordance with the present invention, wherein a top cover for the wet paper towel producing apparatus is removed to show interior structure.

Referring to FIG. 1, a wet paper towel producing apparatus in accordance with the present invention generally includes a housing 40 containing a reservoir 41 therein. Water is pumped by a pump 42 and conveyed by a conduit 43 and then sprayed outside via a nozzle 44. Temperature of the water is controlled by a temperature-controlling device 47. A roll of paper towel 45 or a web of folded paper is guided by and cut by a guiding device 46 to form individual paper towel. Individual paper towel is wetted by water sprayed via the nozzle 44 and then rolled up by a rolling up device in accordance with the present invention.

Figure 2:
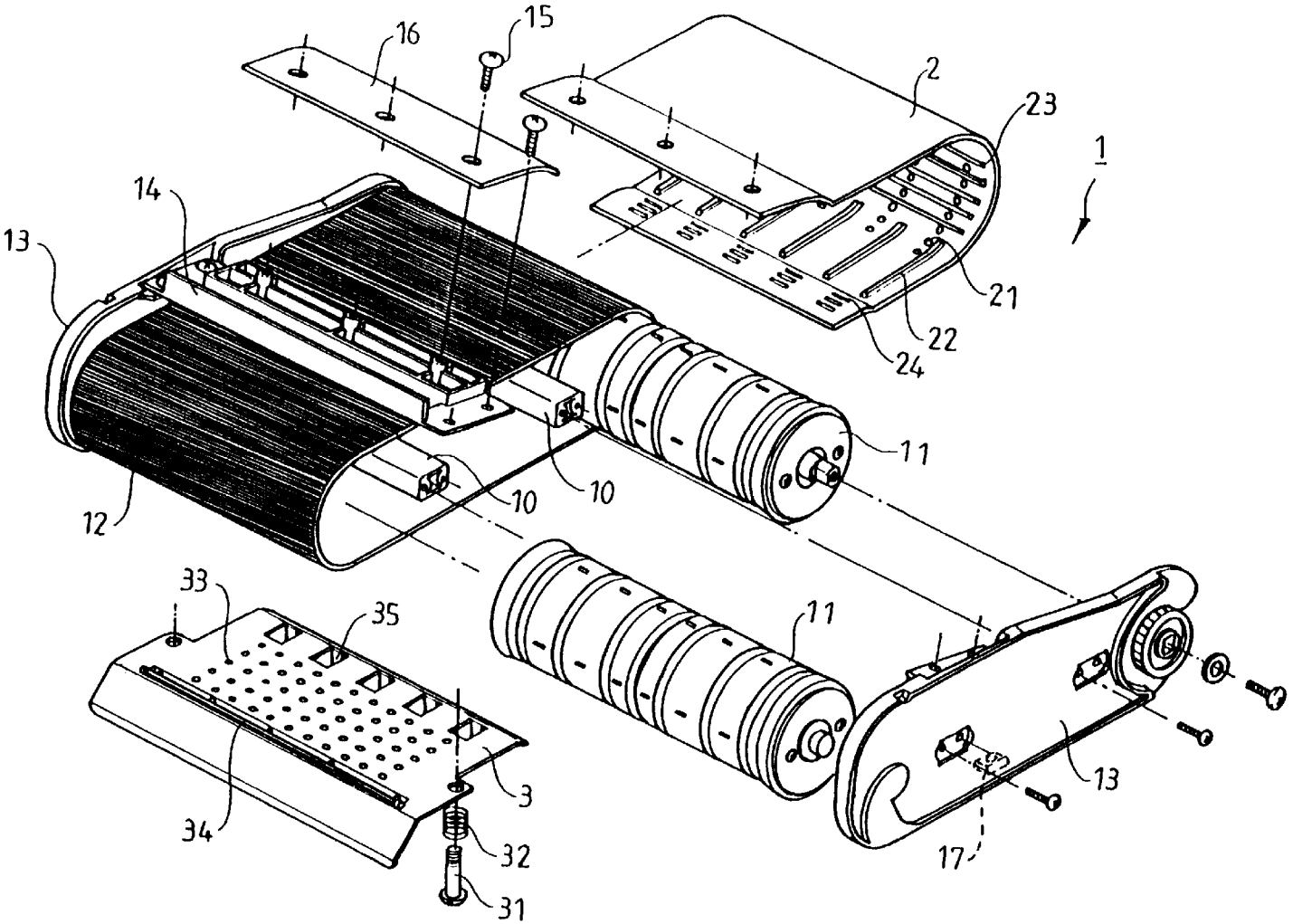
FIG. 2 is an exploded perspective view of the rolling up device in accordance with the present invention.

Referring to FIG. 2, the rolling up device in accordance with the present invention includes a main body 1, a rolling up plate 2, and a water-removing plate 3.

Figure 5:
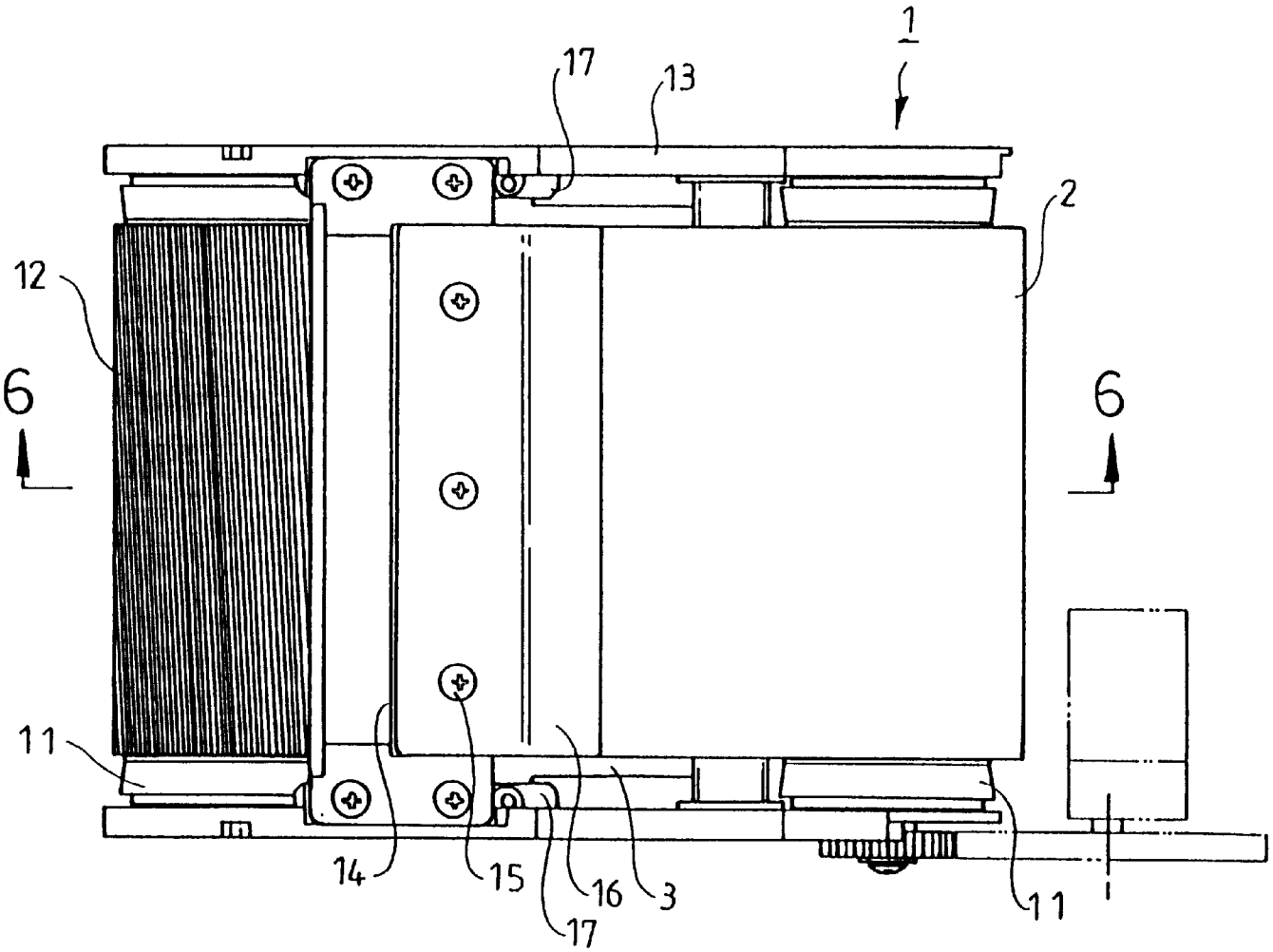
FIG. 5 is a schematic side view of the rolling up device in accordance with the present invention.

The main body 1 includes two spaced side plates 13 that have a certain distance therebetween by transverse rods 10. Two rollers 11 are rotatably mounted between front ends and rear ends of the side plates 13, respectively, and a rolling up belt 12 is mounted around the rollers 11 to rotate therewith. The rolling up belt 12 has a profile lower than that of the side plates 13. Thus, the wet paper towels is restrained by and rolled up between the side plates 13. The rolling up belt 12 includes protruded strips that may have an angle (other than 90°) with a longitudinal direction of the rolling up belt 12, best shown in FIG. 5. Thus, the rolling up belt 12 may urge the wet paper towel forward. A guide seat 14 is mounted between the side plates and has a distance to the rolling up belt 12. The rolling up plate 2 is secured to the guide seat 14 by fasteners 15 and a fixing plate 16.

Figure 3:
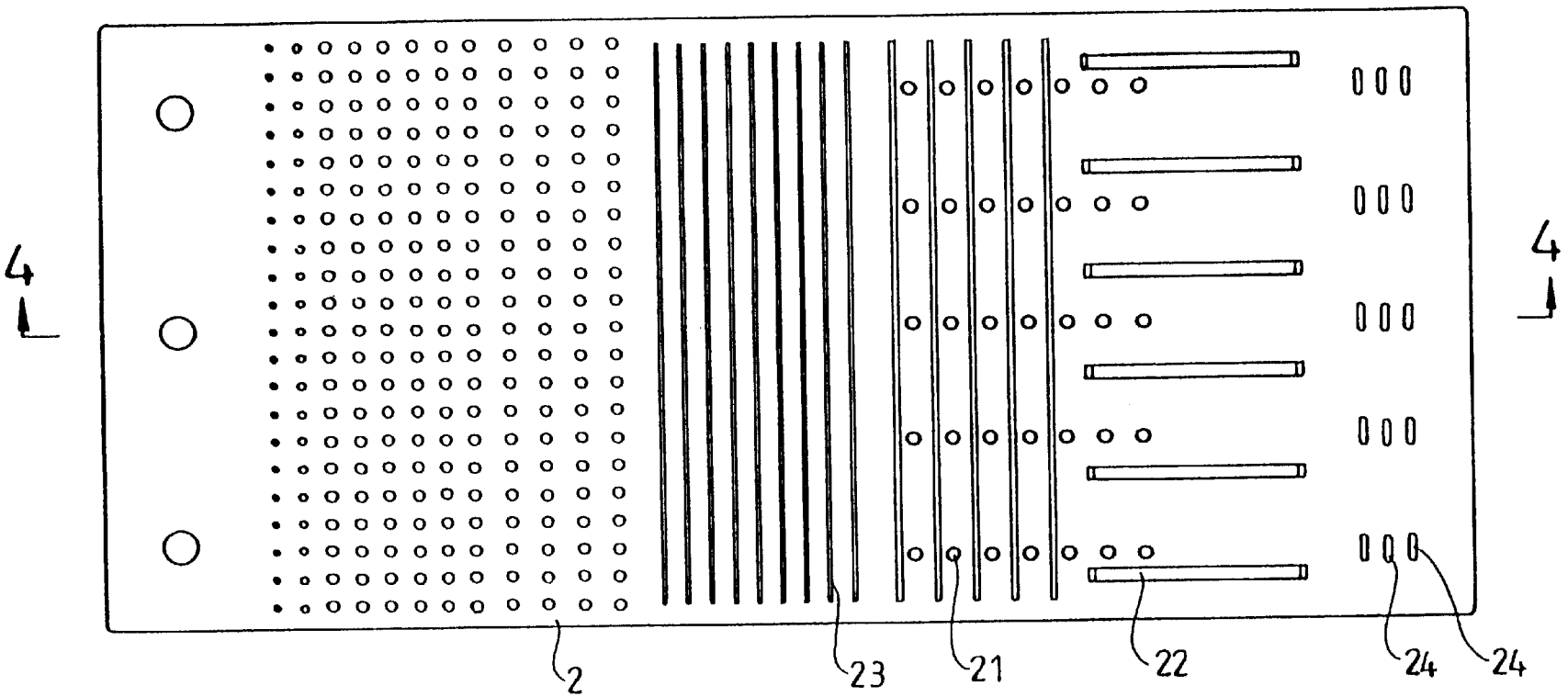
FIG. 3 is a flattened view of a rolling up plate of the rolling up device in accordance with the present invention.
Figure 4:
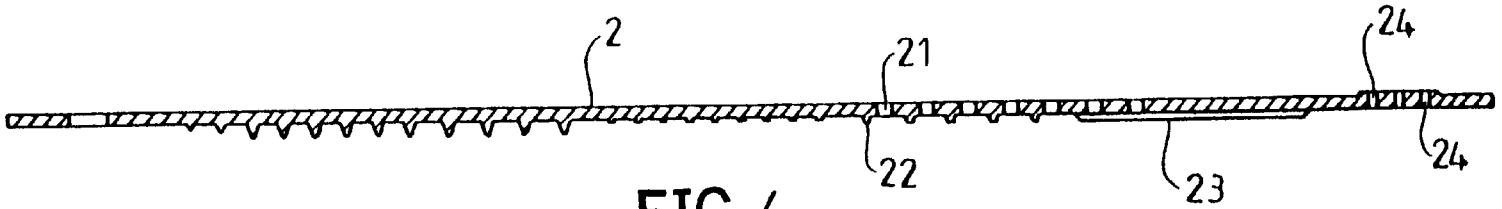
FIG. 4 is a sectional view taken along line 4—4 in FIG. 3.

The rolling up plate 2 and the rolling up belt 12 has an appropriate distance therebetween. A face of the rolling up plate 2 that faces the rolling up belt 12 may be rugged by means of providing longitudinal ribs 22 or transverse ribs 23 on the face of the rolling up plate 2, thereby providing a greater pressing force to the wet paper towel passing through the rolling up plate 2 and the rolling up belt 12. As illustrated in FIGS. 3 and 4, the transverse ribs 23 may have different spacing to roll up individual wet paper towel more densely. The rolling up plate 2 includes a plurality of drainage holes 21 for draining redundant water during rolling up of the wet paper towel. The rolling up plate 2 further includes engaging holes 24 in an end thereof for engaging with the water-removing plate 3.

The water-removing plate 3 includes engaging blocks 35 for engaging with the engaging holes 24 of the rolling up plate 2. The water-removing plate 3 is fixed to an engaging seat 17 on each side plate 13 by a fastener 31. In order to change the distance between the water-removing plate 3 and the rolling up belt 12, an elastic element 32 is mounted between the fastener 31 and the elastic element 32 to bias the water-removing plate 3 upward, such that the water-removing plate 3 and the rolling up belt 12 has an appropriate distance therebetween. In addition, when a wet paper towel is passing through, the distance between the water-removing plate 3 and the rolling up belt 12 is large enough to allow the rolled wet paper towel to pass therethrough. The water-removing plate 3 includes drainage holes 33 to allow drainage of redundant water. Further, in order to keep the rolling up belt 12 dry (to a certain extent), the water-removing plate 3 includes a scraper 34 for scraping a portion of water out of the rolled wet paper towel.

Figure 6:
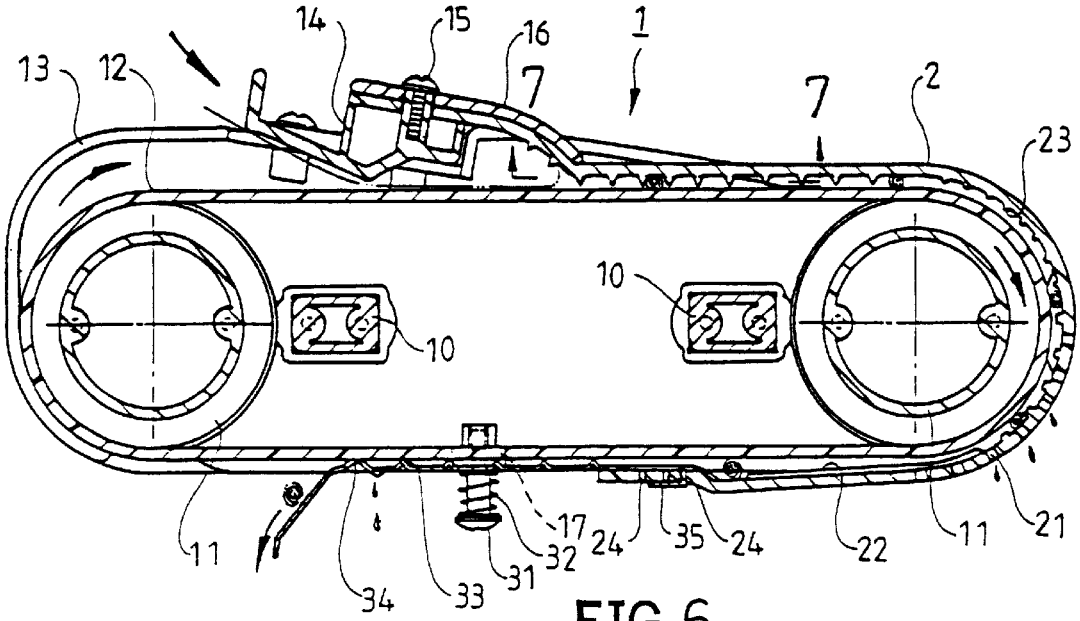
FIG. 6 is a sectional view taken along line 6—6 in FIG. 5.
Figure 7:
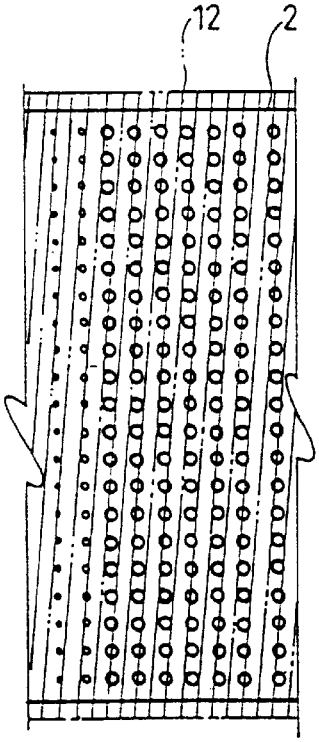
FIG. 7 is a sectional view taken along line 7—7 in FIG. 6.

Referring to FIGS. 6 and 7, the wet paper towel is guided into the rolling up device by the guide seat 14 and then conveyed by the rolling up belt 12 and rubs with the rolling up plate 2, thereby rolling up the wet paper towel. Since the scraper 34 of the water-removing plate 3 comes in contact with the rolling up belt 12, water in the wet paper towel is removed to a certain extent for keeping the rolling up belt 12 dry.

According to the above description, it is appreciated that the wet paper towels can be rolled up automatically and redundant water in the wet paper towels are removed such that each rolled wet paper towel has a certain water content only.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. A rolling up device for wet paper towels, comprising:

a main body including side plates each having a front end and a rear end, two rollers being rotatably mounted between the front ends and the rear ends of the side plates, respectively, a rolling up belt being mounted around the rollers to rotate therewith, a guide seat being mounted between the side plates, the guide seat and the rolling up belt having a distance therebetween to allow a wet paper towel to pass therethrough, each said side plate including an engaging seat thereon;

a rolling up plate fixed to the guide seat, the rolling up plate and the rolling up belt having a distance therebetween to allow the wet paper towel to pass therethrough, the rolling up plate including a plurality of longitudinal ribs, a plurality of transverse ribs, at least one first drainage hole, and at least one engaging hole; and a water-removing plate including at least one engaging block for engaging with said at least one engaging hole of the rolling up plate, the water-removing plate being secured to the engaging seat on each said side plate by a fastener, the water-removing plate and the rolling up plate having a distance therebetween to allow the wet paper towel to pass therethrough, the water-removing plate including at least one second drainage hole and a scraper.

2. The rolling up device as claimed in claim 1, wherein the rolling up belt includes a rugged surface.

3. The rolling up device as claimed in claim 2, wherein the rugged surface of the rolling up belt includes a plurality of protruded strips that have an angle other than 90° with a longitudinal direction of the rolling up belt.

4. The rolling up device as claimed in claim 1, wherein the transverse ribs on the rolling up plate have different spacing.

5. The rolling up device as claimed in claim 1, further comprising an elastic element mounted between the fastener and the water-removing plate, thereby allowing change in the distance between the water-removing plate and the rolling up belt.

* * * * *